US011470932B2

(12) United States Patent
McKelvey et al.

(10) Patent No.: US 11,470,932 B2
(45) Date of Patent: Oct. 18, 2022

(54) LUGGAGE STABILIZER SYSTEM AND METHOD OF USE

(71) Applicants: Sanni McKelvey, Lee's Summit, MO (US); Stephen McKelvey, Lee's Summit, MO (US)

(72) Inventors: Sanni McKelvey, Lee's Summit, MO (US); Stephen McKelvey, Lee's Summit, MO (US)

( * ) Notice: Subject to any disclaimer, the term of this patent is extended or adjusted under 35 U.S.C. 154(b) by 323 days.

(21) Appl. No.: 16/802,971

(22) Filed: Feb. 27, 2020

(65) Prior Publication Data

US 2020/0187611 A1 Jun. 18, 2020

Related U.S. Application Data

(63) Continuation-in-part of application No. 16/683,650, filed on Nov. 14, 2019, which is a continuation-in-part of application No. 15/946,138, filed on Apr. 5, 2018, now Pat. No. 10,512,318.

(60) Provisional application No. 62/481,746, filed on Apr. 5, 2017.

(51) Int. Cl.

| | |
|---|---|
| ***A45C 9/00*** | (2006.01) |
| ***A45C 5/03*** | (2006.01) |
| ***A45C 13/10*** | (2006.01) |
| ***A45C 5/06*** | (2006.01) |
| ***A45C 5/14*** | (2006.01) |

(52) U.S. Cl.

CPC ..... *A45C 9/00* (2013.01); *A45C 5/03* (2013.01); *A45C 5/06* (2013.01); *A45C 5/14* (2013.01); *A45C 13/103* (2013.01); *A45C 2009/002* (2013.01); *A45C 2013/1061* (2013.01)

(58) Field of Classification Search

CPC ..... A45C 2009/002; A45C 9/00; A45C 5/03; A45C 5/06; A45C 13/103; A45C 2013/1061; A45C 5/14

USPC ..... 190/8.18 A, 18 R

See application file for complete search history.

(56) References Cited

U.S. PATENT DOCUMENTS

| | | | |
|---|---|---|---|
| 139,420 | A | 5/1873 | Payne |
| 915,507 | A | 3/1909 | Thomas |
| 930,343 | A | 8/1909 | Bonsall |
| 2,639,793 | A | 5/1953 | Hellman |
| 3,144,946 | A | 8/1964 | Ellis |
| 4,245,763 | A | 1/1981 | Weinberg |
| 4,267,905 | A | 5/1981 | Stewart |

(Continued)

FOREIGN PATENT DOCUMENTS

| | | |
|---|---|---|
| CA | 2081301 | 4/1994 |
| CN | 204812504 | 12/2015 |

(Continued)

*Primary Examiner* — Sue A Weaver

(74) *Attorney, Agent, or Firm* — Law Office of Mark Brown, LLC; Christopher M. DeBacker

(57) ABSTRACT

A luggage system with a wardrobe element which extends from the luggage portion and supports a crossbar for hanging clothing or costumes. An arm extends away from the crossbar for supporting a privacy curtain. The wardrobe element is secured within the sides of the luggage, and the opening of the luggage can be opened and closed without needing to store the wardrobe element. In a preferred embodiment, the wardrobe element includes two pairs of structural legs extending out of respective pockets within the luggage, the legs terminating at the crossbar.

9 Claims, 5 Drawing Sheets

(56) References Cited

U.S. PATENT DOCUMENTS

| | | | | |
|---|---|---|---|---|
| 4,772,133 | A | 9/1988 | Volk | |
| 4,982,820 | A | 1/1991 | Scott | |
| 5,292,565 | A | 3/1994 | Napier et al. | |
| 5,306,063 | A | 4/1994 | Higgins et al. | |
| 5,379,870 | A | 1/1995 | Sadow | |
| 5,582,334 | A | 12/1996 | Blazer et al. | |
| 5,706,921 | A | 1/1998 | Wang | |
| 5,876,009 | A | 3/1999 | Simoncioni et al. | |
| 6,053,378 | A | 4/2000 | Doyel | |
| 6,119,835 | A | 9/2000 | Lin | |
| 6,129,254 | A | 10/2000 | Yu | |
| 6,264,047 | B1 | 7/2001 | Crumley | |
| 6,338,180 | B1 | 1/2002 | Massard | |
| 6,481,574 | B1 | 11/2002 | Pakosh | |
| 7,143,902 | B2 | 12/2006 | Iverson et al. | |
| 7,232,169 | B2 | 6/2007 | Porter | |
| 7,607,535 | B2 | 10/2009 | Jackson | |
| 8,182,030 | B1 * | 5/2012 | Britten | A47D 13/025 297/118 |
| 8,490,764 | B2 | 7/2013 | Simester | |
| 8,714,369 | B2 | 5/2014 | Liu et al. | |
| 9,101,187 | B2 | 8/2015 | Zheng | |
| 9,622,597 | B2 | 4/2017 | White | |
| 9,820,542 | B2 * | 11/2017 | McKelvey | A45C 13/103 |
| 10,016,034 | B2 | 7/2018 | Lee | |
| 10,271,644 | B1 | 4/2019 | Johnson | |
| 10,512,318 | B2 | 12/2019 | Mckelvey | |
| 2006/0249550 | A1 | 11/2006 | Giampavolo | |
| 2007/0089952 | A1 | 4/2007 | Herbst et al. | |
| 2007/0256994 | A1 | 11/2007 | Jackson | |
| 2007/0295570 | A1 | 12/2007 | Campbell et al. | |
| 2009/0000894 | A1 * | 1/2009 | Middup | A45C 13/02 190/15 R |
| 2009/0321204 | A1 | 12/2009 | Barkow | |
| 2011/0120826 | A1 | 5/2011 | Middup | |
| 2014/0027227 | A1 | 1/2014 | Stern | |
| 2014/0326562 | A1 | 11/2014 | Pickens et al. | |
| 2015/0173475 | A1 | 6/2015 | Dermody | |
| 2016/0022032 | A1 | 1/2016 | Simon | |
| 2016/0113388 | A1 * | 4/2016 | Distefano | A45C 5/14 108/41 |
| 2017/0071302 | A1 | 3/2017 | Mckelvey | |
| 2017/0071382 | A1 | 3/2017 | Dehghan Dehnavi | |
| 2018/0271310 | A1 * | 9/2018 | Klugh | A47G 23/0225 |

FOREIGN PATENT DOCUMENTS

| | | |
|---|---|---|
| GB | 2490957 | 11/2012 |
| WO | 2007019379 | 2/2007 |

* cited by examiner

LUGGAGE STABILIZER SYSTEM AND METHOD OF USE

CROSS-REFERENCE TO RELATED APPLICATION

This application is a continuation in part of U.S. patent application Ser. No. 16/683,650, filed Nov. 14, 2019, which is a continuation-in-part of and claims priority in U.S. patent application Ser. No. 15/946,138 filed Apr. 5, 2018, now U.S. Pat. No. 10,512,318, which claims priority in U.S. Provisional Patent Application No. 62/481,746 filed Apr. 5, 2017, which are incorporated herein by reference.

BACKGROUND OF THE INVENTION

1. Field of the Invention

The present invention relates generally to a stabilizer system for a collapsible wardrobe and luggage system and method for use thereof, and more specifically to a stabilizer for use with the telescoping handle arms of a wardrobe and luggage system and storage thereof.

2. Description of the Related Art

Dancers, performers, travelers, or anyone else often need to quickly change clothing or costumes in public places. Typical luggage requires the user to sift through piles of clothing to find the correct article. Existing luggage with wardrobe attachments require the wardrobe bar to extend from the storage compartment of the luggage, rendering the luggage unable to close while the wardrobe feature is in use. Further, these wardrobe features are typically made to be as lightweight and as cheap as possible, typically having a single structural post extending away from the luggage on either side of the crossbar. While the luggage is open, contents stored within are susceptible to theft. These also lack the ability to provide privacy to the user when changing outfits or costumes.

What is needed is a structurally superior wardrobe element for luggage which allows the luggage to remain fully functional while the wardrobe is in use, while the wardrobe further provides privacy to the user. What is further needed is a stabilizer system for increasing the structural superiority of such wardrobe elements.

Heretofore there has not been available a stabilizer system for a luggage wardrobe system or method of use with the advantages and features of the present invention.

BRIEF SUMMARY OF THE INVENTION

The present invention generally provides a stabilizer device for a luggage system with a wardrobe element which extends from the luggage portion and which can support a crossbar for hanging clothing or costumes. Optional arms can extend away from the crossbar for supporting a privacy curtain as defined in U.S. Pat. Nos. 10,506,856 and 9,820,542, which are commonly owned by the Applicant of the present invention and are incorporated herein by reference. The wardrobe element is secured within the sides of the luggage, and the opening of the luggage can be opened and closed without needing to store the wardrobe element. In a preferred embodiment, the wardrobe element includes two pairs of structural legs extending out of respective pockets within the luggage, the legs terminating at the crossbar. The stabilizer element is used between each pair of supports forming the legs, and when not in use is sored within a pocket adjacent to the stored location of the legs. The preferred embodiment is ideal for use when traveling or performing, which may require the user to change multiple outfits or costumes in an otherwise public area.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Stabilizer System 2

Figures 1, 1A:
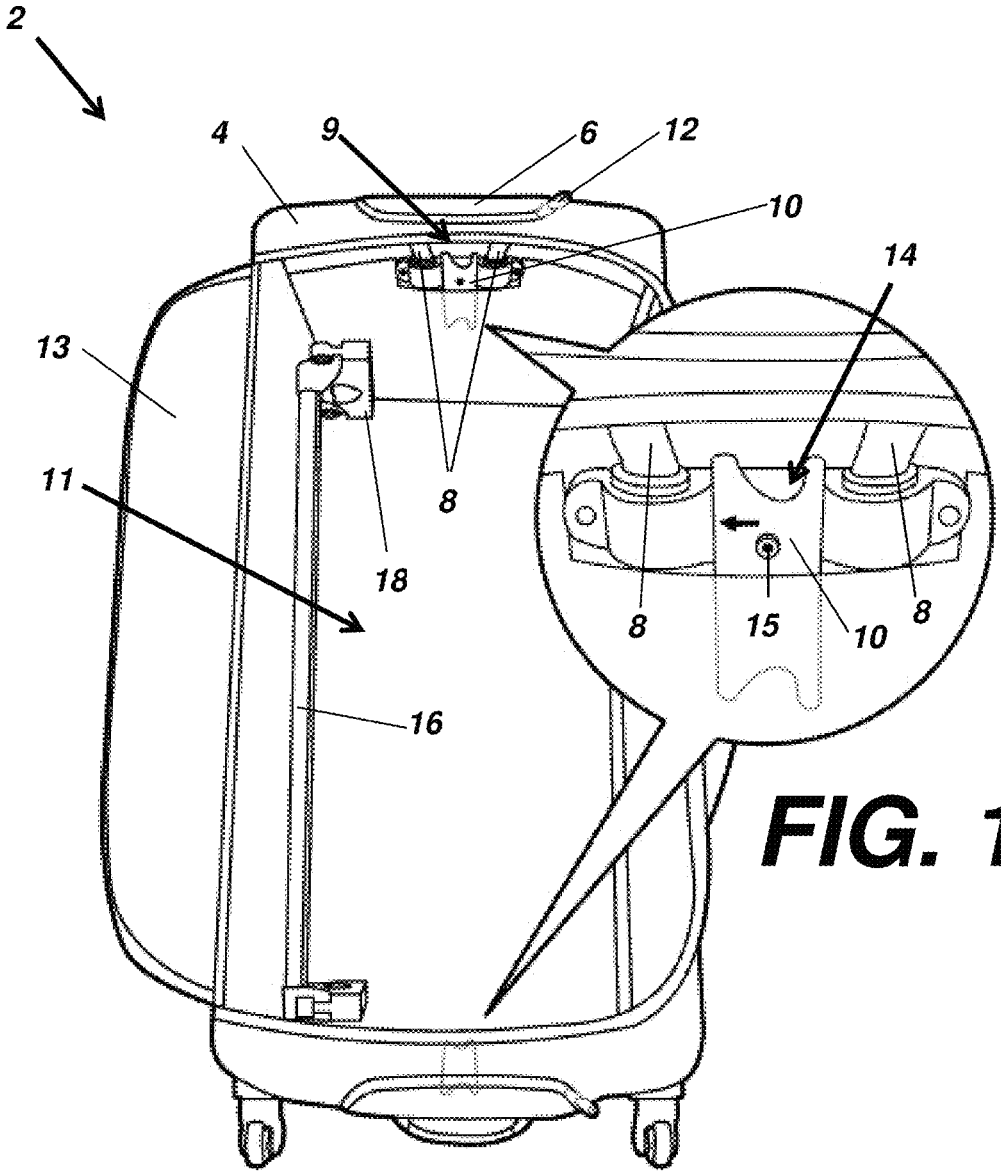
FIG. 1 is a top plan view of a preferred embodiment of the present invention showing a stabilizer element in a stored orientation.
FIG. 1A is a detailed view taken about the indicated portions of FIG. 1.

FIG. 1 shows a preferred luggage wardrobe stabilizer system 2 in a stored position, with a pair of supports 9 each having telescoping legs 8 which extend outward from within the luggage storage compartment side passages 26 of the luggage wardrobe 4, such as taught by U.S. Pat. Nos. 10,506,856 and 9,820,542, which are commonly owned by the Applicant of the present invention and are incorporated herein by reference. The luggage wardrobe 4 generally comprise a suitcase or other typical luggage device having a storage compartment, a closeable lid, various handles for carrying the luggage. Side handles 28 are also included and cap the telescoping legs 8 to help the user carry the luggage wardrobe 4.

Each of the pair of supports 9 extend through separately enclosed side passages 26 having their own flaps 6 which seal using a zipper 12 or other closure device, allowing the supports 9 to remain extended while the main compartment 11 of the luggage wardrobe 4 remains closed. This allows the lid 13 to be securely locked or otherwise fastened shut to protect the contents of the luggage wardrobe 4 while the supports 9 are extended upward.

A rod 16 may be connected to the top of the supports 9 using a storage crown 18 or other element, such as taught by U.S. Pat. No. 10,512,318 and U.S. patent application Ser. No. 16/683,650, which are commonly owned by the Applicant of the present invention and are incorporated herein by reference. This allows the rod 16 to be placed at an elevated position ideal for receiving clothing or costumes placed on clothes hangers or other hanging elements. An optionally removable privacy curtain arm connects to one or both ends of the rod, allowing a privacy curtain to be extended out and away from the luggage for privacy while the user is changing clothing. The rod 16 may be a telescoping rod for easy storage. The lid 13 could attach to the rod 16 and/or the supports 9 for additional functionality and privacy. A storage crown 18 could be placed atop each handle 28 and the rod 16 extended between two crowns. The crowns include features as taught in U.S. Pat. No. 10,512,318 and U.S. patent application Ser. No. 16/683,650, incorporated herein by reference, which add additional storage and functionality to the present application.

Figure 2:
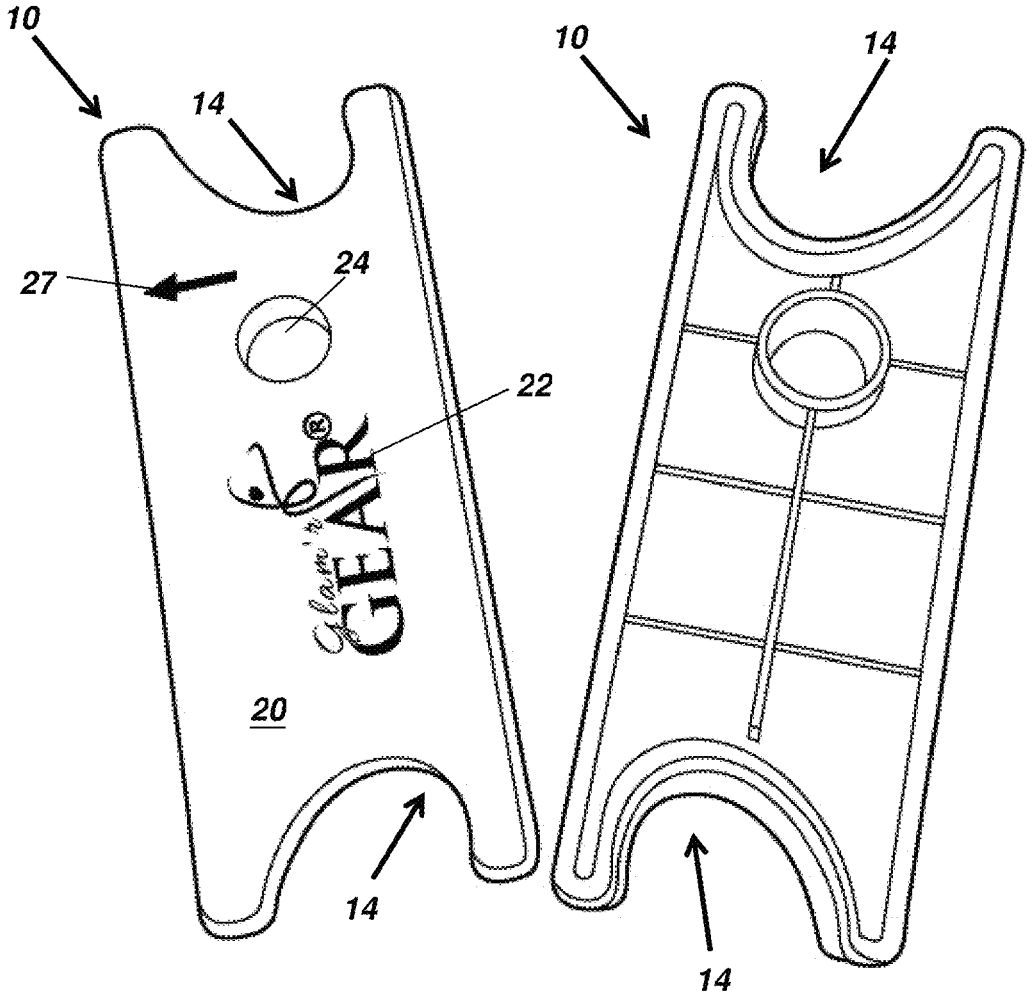
FIG. 2 is a top plan view of a pair of stabilizer elements thereof.
Figures 3, 3A:
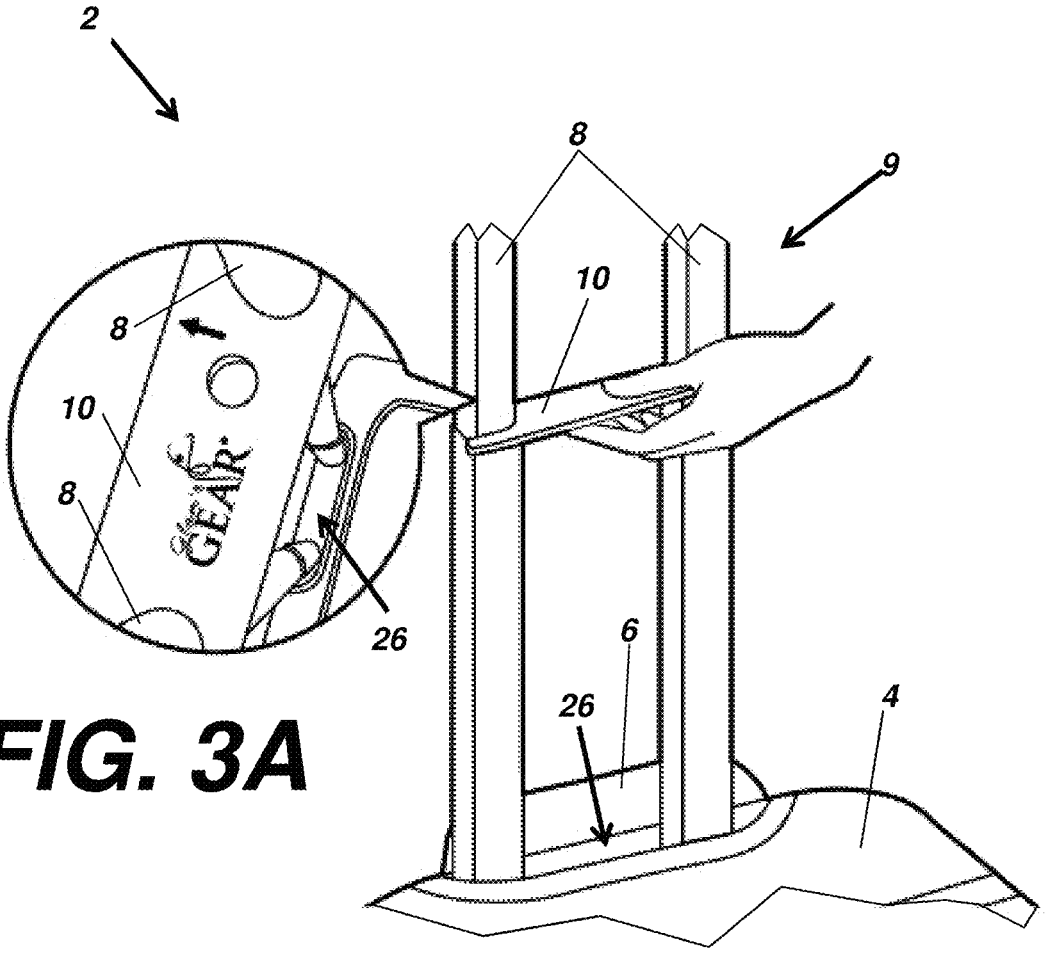
FIG. 3 is a partial three-dimensional isometric view of the embodiment of FIG. 1A showing the stabilizer element in an engaged orientation.
FIG. 3A is a detailed view taken about the indicated portion of FIG. 3.
Figure 4:
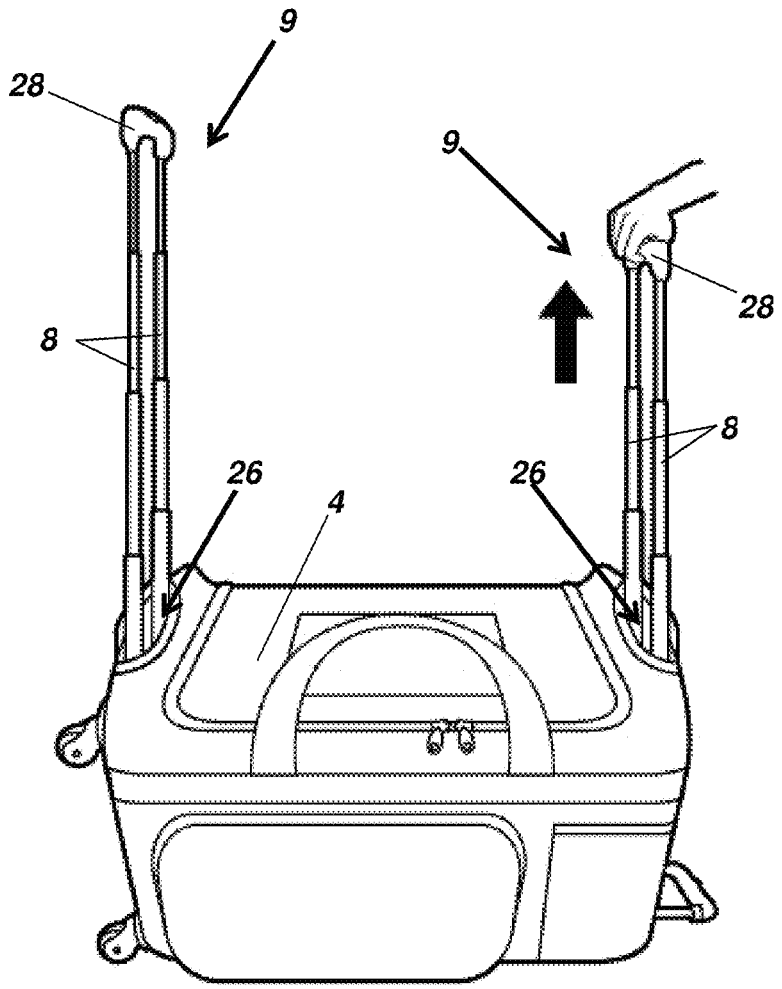
FIG. 4 is a three-dimensional frontal view of the luggage wardrobe system with which the present embodiment interacts.

A stabilizer 10 is shown in FIG. 1 in a stored position, where a hole 24 through the stabilizer body 20 is connected to a connector 15 within the compartment 26 where the supports 9 are stored. The stabilizer 10 can be removed from the compartment and from the connector 15 and placed between the two telescoping legs 8 as shown in FIG. 3 to support the legs and add stability to the entire system. Notches 14 on the stabilizer receive the telescoping legs 8 when the stabilizer 10 is inserted between the legs in the direction of the arrow 27. In a piece of luggage where the legs 8 are round or another shape, the notches 14 would reflect the shape of the legs, and therefore the arrow 27 may not be required. A customized logo 22, such as the Glam'r Gear® logo, owned by the Applicant of the present application, shown in FIG. 2, may be applied to the stabilizer 10 body 20 if desired to customize the stabilizer.

Figure 5:
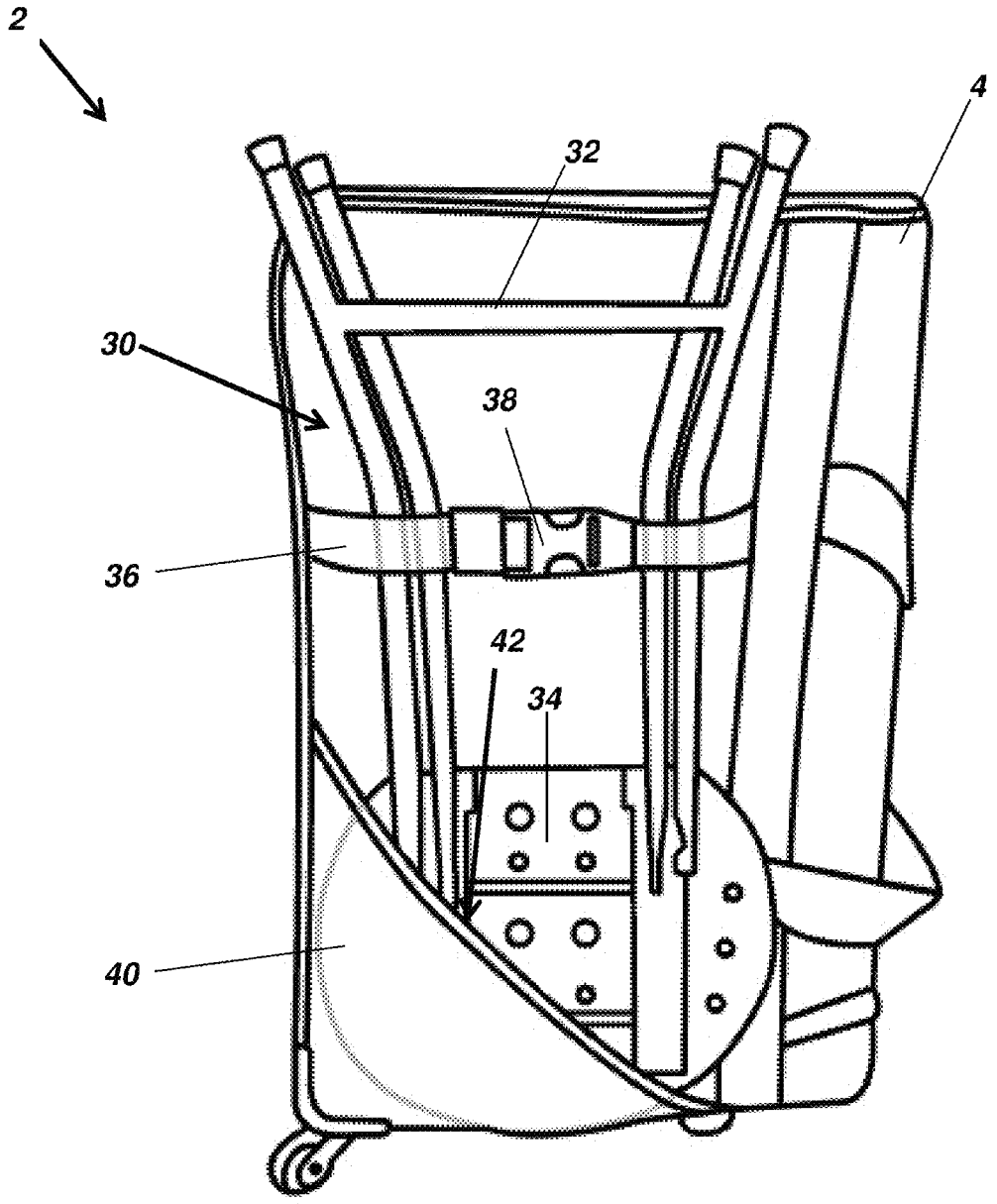
FIG. 5 is a side elevational view of the embodiment thereof shown tipped on an end and storing a portable stool.

FIG. 5 shows how a portable stool 30 can be secured to the side of the luggage wardrobe 4 using a strap 36 having a buckle 38 to hold the legs 32 of the stool 30, and a corner pocket 40 storing a portion of the seat 34 of the stool 30 within an opening 42. This makes it easy for the user to bring a portable stool with their luggage wardrobe for preparing or relaxing before or after an event.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A wardrobe system comprising:

a luggage wardrobe having a lid, a base, two side walls, and two end walls, said base, side walls, and end walls creating an interior space;

a structural support extending upwardly from said base of said storage compartment;

said structural support comprised of a pair of telescoping legs configured to be transformed from a first, stored position to a second, deployed position;

a stabilizer configured to be removably inserted between said pair of telescoping legs of said structural support, thereby stabilizing said structural support;

said stabilizer comprising a pair of notches, each one of said pair of notches configured to engage one of said pair of telescoping legs;

a connector located within said interior space of said luggage wardrobe in proximity with said structural support; and said stabilizer having a hole configured to be receive said connector, thereby storing said stabilizer within said interior space of said luggage wardrobe.

2. The wardrobe system of claim 1, further comprising:

a storage crown configured to be placed atop said structural support; and said storage crown configured to receive clothing hangers.

3. The wardrobe system of claim 1, further comprising:

an opening located in said luggage wardrobe, said opening corresponding with said structural support; and said opening configured to allow access to said structural support without opening said lid of said luggage wardrobe.

4. The wardrobe system of claim 3, wherein said opening is sealed with a zipper.

5. The system of claim 1, further comprising:

a strap having a buckled configured for securing said strap about a body; and a side pocket locating on an exterior of one of said side walls of said luggage wardrobe, said side pocket configured for receiving and securing a portion of said body.

6. The system of claim 5, wherein said body comprises a foldable stool having legs and a seat.

7. The system of claim 6, wherein said side pocket comprises a diagonal opening and wherein said portion of said body comprises a portion of said seat.

8. The system of claim 1, further comprising at least two wheels affixed to an exterior of said storage compartment.

9. The system of claim 1, further comprising a plurality of storage compartments affixed to an exterior of said storage compartment.

* * * * *